United States Patent [19]

Rohner et al.

[11] 4,346,497

[45] Aug. 31, 1982

[54] DEVICE FOR REMOVING DUST FROM A WINDING MACHINE

[75] Inventors: Joachim Rohner, Monchen-Gladbach; Edmund Wey, Nettetal, both of Fed. Rep. of Germany

[73] Assignee: W. Schlafhorst & Co., Monchen-Gladbach, Fed. Rep. of Germany

[21] Appl. No.: 149,704

[22] Filed: May 14, 1980

[30] Foreign Application Priority Data

May 16, 1979 [DE] Fed. Rep. of Germany ..... 2919768

[51] Int. Cl.[3] ..... A47L 5/38

[52] U.S. Cl. ..... 15/301; 15/345

[58] Field of Search ..... 15/301, 345; 242/35.5 R

[56] References Cited

U.S. PATENT DOCUMENTS

| | | | |
|---|---|---|---|
| 1,982,997 | 12/1934 | Linder | 242/35.5 R |
| 2,977,181 | 3/1961 | Reiterer | 15/301 |
| 3,834,634 | 9/1974 | Havlas | 242/35.5 R |

*Primary Examiner*—Robert W. Jenkins

*Attorney, Agent, or Firm*—Herbert L. Lerner; Laurence A. Greenberg

[57] ABSTRACT

Device for removing dust from a winding machine, including an air suction channel disposed alongside and adjacent to a run-off coil, the air suction channel having at least one suction opening formed therein in longitudinal direction of the run-off coil.

9 Claims, 3 Drawing Figures

FIG.1
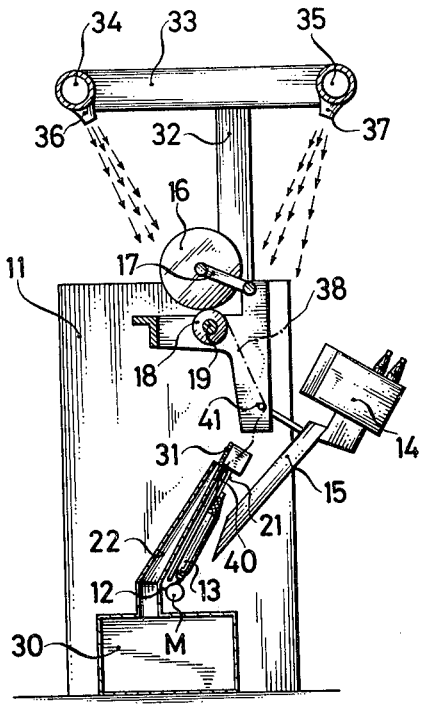
FIG. 2
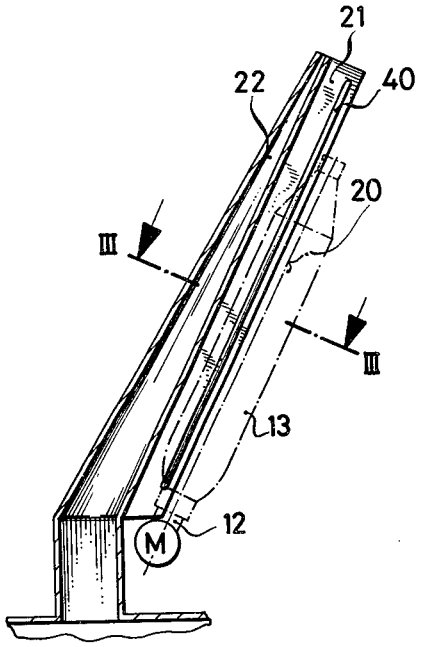
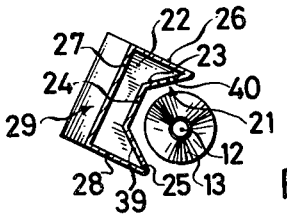
FIG. 3

DEVICE FOR REMOVING DUST FROM A WINDING MACHINE

The invention relates to a device for removing dust from a winding machine, particularly from an automatic winding machine.

It is known to remove dust and fiber particles by suction from the region surrounding the running thread or threads. It is also known to blow off already-deposited dust and fiber particles, and to suck them off thereafter. Furthermore there are conventional provisions by which air-conditioned air is brought in contact with the running threads to improve their processing properties or workability, or to keep the operating conditions constant. However, no provision has been made to eliminate the depositing of these particles into the surroundings.

Contrary to all these measures, it is an object of the invention to provide a device for removing dust from a winding machine, which overcomes the hereinaforementioned disadvantages of the heretofore-known devices of this general type, and to prevent the discharge of dust and fiber particles into the ambient air of a machine-room in which the winding machine is located.

With the foregoing and other objects in view there is provided, in accordance with the invention, a device for removing dust from a winding machine, comprising an air suction channel disposed alongside and adjacent to a run-off coil, the air suction having at least one suction opening formed therein in longitudinal direction of the run-off coil.

In accordance with another feature of the invention, there is provided a trough connected to the air suction channel and disposed parallel to the longitudinal axis of the run-off coil.

The invention is based on the recognition that in a winding machine of conventional construction, most of the dust and fiber particles are generated in the regions where the thread runs off the run-off coil. For this reason, in order to keep the air clean, the attention was focused on the run-off coil. If the run-off coil and the thread which is running off is made clean first, then the other dust removal measures are not necessary in many cases. However, the invention does not exclude the use of additional dust removal measures.

For example, it can also be advantageous to arrange additional special blow-nozzles which are directed toward machine parts that are in contact with the thread. Therefore, in accordance with still another feature of the invention, there are provided means for blowing air onto a thread pulled from the run-off coil and means connected to the suction opening for collecting dust removed from the run-off coil and thread. The invention can also be used successfully in conjunction with an air-screen or curtain. The suction openings of the air-suction channel, for example, can be dimensioned so large that the additional air from an air screen installation or from blower-nozzles can flow around the run-off coil, and then get into the air suction channel.

In accordance with a further feature of the invention, the trough is integral with the air-suction channel. In this way a particularly simple device results because the air-suction channel is formed as a trough. With this construction it does not present a problem to provide, in accordance with an added feature of the invention, that the at least one suction opening is in the form of two suction openings disposed in two rows and directed toward the run-off coil from different sides thereof. These suction openings are feasible in different arrangements. In the most simple case they are longitudinal slots, which extend along the length of the coil. Interrupted slots, or rows of holes would also be advantageous. The decision whether slots or rows of holes would serve the purpose better, must be made from case to case, with consideration of material chosen and its strength.

In accordance with an additional feature of the invention, the trough has walls forming a polygon partially surrounding the run-off coil as viewed in cross-sectional direction of the trough. In this case the air-suction channel and the trough, respectively, can be made of angularly-bent sheet-metal.

In accordance with yet another feature of the invention, the trough and air suction channel have upper ends, and there is provided a thread balloon breaker disposed at the upper ends above the run-off coil. Though the trough could also serve as a thread balloon breaker, or as a part thereof, it has been proven to be more advantageous to provide a special thread balloon breaker above the run-off coil in automatic winding machines. The action of the thread hitting against the walls of the thread-balloon breaker loosens dust and fiber parts which are also sucked-off through the suction openings.

The run-off coil is not enclosed on all sides for a good reason. It has to be considered that the run-off coil must be easily mounted and hinged together with the mounting pin, respectively. This is especially important with automatic winding-machines. It was proven to be necessary to form the suction openings in a trough which is open at one side and to dispose the run-off coil in this trough at a distance from the walls of the trough; however this construction also proved to be sufficient for complete dust-removal from the run-off coil. The mounting of the run-off coil on its mounting pin, and the removal of the empty bobbin tube is in no way obstructed by the invention. Therefore, in accordance with a concomitant feature of the invention, there are provided means for pivotably mounting the run-off coil at a distance from the air suction channel.

Summarizing, the advantages achieved by the invention are seen in the fact that the dust is immediately sucked up at its point of origin, so that dust content of the air to be breathed in the control-and working area remains very low. Therefore the winding machine does not require covers, and is visible and freely accessible at all times.

Other features which are considered as characteristic for the invention are set forth in the appended claims.

Although the invention is illustrated and described herein as embodied in a device for removing dust from a winding machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 1 is a diagrammatic simplified side-elevational view of a winding station, with a cross section taken through the device according to the invention;

FIG. 2 is an enlarged, diagrammatic, longitudinal sectional view taken through the device according to the invention; and FIG. 3 is a cross-sectional view of the device shown in FIG. 2, taken along the line III-III thereof.

Referring now to the figures of the drawing and first particularly to FIG. 1 thereof, there is seen a winding station 11 of a winding machine which comprises many similar winding stations and is provided with a mounting pin 12 which is hingeable around the axis M and carries a run-off coil 13. The run-off coil in this case is the spinning bobbin of a ring spinning frame or machine. There are further shown a run-off coil magazine 14 with a drop-chute 15 through which a new run-off bobbin is guided onto the mounting pin 12 which can be swung slightly downward for this purpose.

Furthermore, FIG. 1 shows a take-up coil 16 which is held by a hingeable frame 17. The take-up coil 16 lies on a grooved rotating drum 18 which is driven by a shaft 19 extending from winding station to winding station.

In the drawings of FIG. 1 and FIG. 2 it is also seen that a trough 21 is parallelly disposed with respect to the longitudinal axis 20 of the coil 13 and is also a part of the air-suction channel 22. The walls 23, 24, 25 of the trough 21 and the walls 26, 27, 28 of the air suction channel 22 are formed in such a way, according to FIGS. 1 to 3, that as seen in cross-sectional direction a polygon 29 appears which partially surrounds the run-off coil 13. The hereinafore-mentioned walls are made of angled sheet metal. The air-suction channel 22 ends in an air collection duct or channel 30.

At the upper end of the trough 21, above the run-off coil 13, a thread balloon breaker 31 is disposed. The thread balloon breaker 31 has the form of a longitudinally slotted four-cornered tube.

Above the winding station 11, there are also seen two blower-lines 34, 35 which are carried by supports 32, 33 and are provided with blower nozzles 36, 37. The blower nozzles 36, 37 are directed toward the machine parts which are in contact with the running thread 38.

The air channel 22 is provided with two suction openings 39, 40 which are formed along the run-off coil 13, and both extend beyond the end of the coil 13. The suction openings 39, 40 are in the shape of slits and are disposed in two rows in such a manner that they are directed toward the run-off coil 13 from different directions. It can be seen from FIG. 3 that the suction opening 39 is formed in the wall 25, and the suction opening 40 is formed in the wall 23 of the trough 21 and of the air suction channel 22, respectively. In the embodiment shown, the suction openings are directed toward the surface of the run-off coil 13 from two sides thereof, being 90° displaced from each other. That is to say, in relation to the run-off coil 13, the suction opening 39 is displaced 90° from the suction opening 40.

It is clearly shown in the figures that the run-off coil 13 is maintained at a distance from the walls of the trough 21 and does not touch these walls at any place. During operation, the thread 38 is pulled over the top of the run-off coil 13. It runs through the thread-balloon breaker 31, is guided over a thread guiding element 41, runs through the reverse thread grooves of the grooved drum 18, and is wound-up onto the take-up coil 16.

The spacing between the walls of the trough 21 and the surface of the run-off coil 13 is so dimensioned in the embodiment shown that the thread does not touch the walls.

In another embodiment which is not specifically shown in the drawings, the walls of the trough 21 are closer to the surface of the run-off coil 13 so that the thread which is drawn off touches the walls. But in this case, the contact is intended, and should improve the effect of the thread-balloon breaker. In this way the invention can be utilized advantageously for improving the thread balloon breaking operation.

The invention is not limited to the embodiment shown and described. For example it is feasible to form the trough 21 with a semi-circular cross-section. The trough would have, in this case, the form of a cut-out cylinder. Several possibilities also exist with respect to the construction of the suction openings. For example, it is feasible to form the suction opening or openings at the bottom of the trough in only a single longitudinal row. Instead of the perforating slots shown, interrupted slits or rows of holes could also be used.

There are claimed:

1. Device for removing dust from a winding machine, comprising an air suction channel disposed alongside and adjacent to a run-off coil having thread being unwound therefrom, said air suction channel having at least one suction opening formed therein in longitudinal direction of the run-off coil, and a trough being integral with said air suction channel and disposed parallel to to the longitudinal axis of the run-off coil.

2. Device according to claim 1, wherein said at least one suction opening is in the form of two suction openings disposed in two rows and directed toward the run-off coil from different sides thereof.

3. Device according to claim 1, wherein said trough has walls forming a polygon partially surrounding the run-off coil as viewed in cross-sectional direction of said trough.

4. Device according to claim 1, wherein said trough and air suction channel have upper ends, and including a thread balloon breaker disposed at said upper ends above the run-off coil.

5. Device according to claim 1, including means for blowing air onto a thread pulled from the run-off coil and means connected to said suction opening for collecting dust removed from the run-off coil and thread.

6. Device according to claim 1, including means for pivotably mounting the run-off coil at a distance from said air suction channel.

7. Device according to claim 1, wherein said integral air suction channel and trough are disposed directly adjacent the run-off coil in radial direction thereof, between the run-off coil and other parts of the winding machine.

8. Device according to claim 1, wherein thread is pulled off the run-off coil upward.

9. Device according to claim 1, wherein said trough extends partly around the run-off coil in the circumferential direction.

* * * * *